US011371361B2

(12) United States Patent
Akturk et al.

(10) Patent No.: US 11,371,361 B2
(45) Date of Patent: Jun. 28, 2022

(54) TURBINE BLADE AND CORRESPONDING SERVICING METHOD

(71) Applicant: Siemens Energy Global GmbH & Co. KG, Munich (DE)

(72) Inventors: Ali Akturk, Oviedo, FL (US); Taylor Hynds, Manchester, CT (US); Krishan Mohan, Orlando, FL (US); David Monk, St. Cloud, FL (US); Jose L. Rodriguez, Longwood, FL (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 206 days.

(21) Appl. No.: 16/639,245

(22) PCT Filed: Aug. 7, 2018

(86) PCT No.: PCT/US2018/045521
§ 371 (c)(1),
(2) Date: Feb. 14, 2020

(87) PCT Pub. No.: WO2019/036222
PCT Pub. Date: Feb. 21, 2019

(65) Prior Publication Data

US 2020/0256198 A1 Aug. 13, 2020

(30) Foreign Application Priority Data

Aug. 16, 2017 (EP) ..... 17186342

(51) Int. Cl.
*F01D 5/20* (2006.01)

(52) U.S. Cl.
CPC ..... *F01D 5/20* (2013.01); *F05D 2230/10* (2013.01); *F05D 2230/80* (2013.01); *F05D 2240/307* (2013.01); *F05D 2240/55* (2013.01)

(58) Field of Classification Search
CPC ..... F05D 2240/307; F01D 5/20; F01D 11/08
See application file for complete search history.

(56) References Cited

U.S. PATENT DOCUMENTS 6,179,556 B1 * 1/2001 Bunker ..... F01D 5/187 415/115
6,190,129 B1 * 2/2001 Mayer ..... F01D 5/187 416/235

(Continued)

FOREIGN PATENT DOCUMENTS

EP 2378076 A1 10/2011
EP 2987956 A1 2/2016

(Continued)

OTHER PUBLICATIONS

PCT International Search Report and Written Opinion dated Sep. 13, 2018 corresponding to PCT Application Mo. PCT/US2018/045521 filed Aug. 7, 2018.

*Primary Examiner* — Eldon T Brockman

(57) ABSTRACT

A turbine blade tip includes a tip cap disposed over a blade airfoil and having a pressure side edge and a suction side edge. A notch is formed by a radially inward step adjacent to the suction side edge of the tip cap. The notch is defined by a radially extending step wall and a radially outward facing land. The step wall extends radially inward from the suction side edge of the tip cap to the land, whereby the land is positioned radially inward in relation to a radially outer surface of the tip cap. The notch extends along at least a portion of the suction sidewall in a direction from the leading edge to the trailing edge. In a further aspect, a method is provided for servicing a blade that includes machining a suction side notch as described above.

13 Claims, 5 Drawing Sheets

(56) References Cited

U.S. PATENT DOCUMENTS

| | | | | |
|---|---|---|---|---|
| 6,422,821 | B1 * | 7/2002 | Lee | F01D 5/186 416/224 |
| 8,113,779 | B1 * | 2/2012 | Liang | F01D 5/20 416/92 |
| 8,777,572 | B2 * | 7/2014 | Cheong | F01D 5/20 416/97 R |
| 9,453,419 | B2 * | 9/2016 | Auxier | F01D 5/186 |
| 2002/0090301 | A1 * | 7/2002 | Lee | F01D 5/20 416/224 |
| 2002/0187044 | A1 * | 12/2002 | Lee | F01D 5/18 416/97 R |
| 2007/0059173 | A1 | 3/2007 | Lee et al. | |
| 2011/0255990 | A1 | 10/2011 | Diamond et al. | |
| 2012/0189458 | A1 * | 7/2012 | Cheong | F01D 5/20 416/235 |

FOREIGN PATENT DOCUMENTS

| | | | |
|---|---|---|---|
| JP | 2007077986 | A | 3/2007 |
| WO | 2015094498 | A1 | 6/2015 |

* cited by examiner

View II-II

View IV-IV

View V-V

View VI-VI

TURBINE BLADE AND CORRESPONDING SERVICING METHOD

BACKGROUND

1. Field

The present invention relates to turbine blades for gas turbine engines, and in particular to turbine blade tips.

2. Description of the Related Art

In a turbomachine, such as a gas turbine engine, air is pressurized in a compressor section and then mixed with fuel and burned in a combustor section to generate hot combustion gases. The hot combustion gases are expanded within a turbine section of the engine where energy is extracted to power the compressor section and to produce useful work, such as turning a generator to produce electricity. The hot combustion gases travel through a series of turbine stages within the turbine section. A turbine stage may include a row of stationary airfoils, i.e., vanes, followed by a row of rotating airfoils, i.e., turbine blades, where the turbine blades extract energy from the hot combustion gases for providing output power.

Typically, a turbine blade is formed from a root at one end, and an elongated portion forming an airfoil that extends outwardly from a platform coupled to the root. The airfoil comprises a tip at a radially outward end, a leading edge, and a trailing edge. The tip of a turbine blade often has a tip feature to reduce the size of the gap between ring segments and blades in the gas path of the turbine to prevent tip flow leakage, which reduces the amount of torque generated by the turbine blades. The tip features are often referred to as squealer tips and are frequently incorporated onto the tips of blades to help reduce pressure losses between turbine stages. These features are designed to minimize the leakage between the blade tip and the ring segment.

SUMMARY

Briefly, aspects of the present invention provide a turbine blade with an improved blade tip design for controlling leakage flow.

According to a first aspect of the invention, a turbine blade is provided. The turbine blade comprises an airfoil comprising an outer wall formed by a pressure sidewall and a suction sidewall joined at a leading edge and at a trailing edge. The blade comprises a blade tip at a first radial end and a blade root at a second radial end opposite the first radial end for supporting the blade and for coupling the blade to a disc. The blade tip comprises a tip cap disposed over the outer wall of the airfoil. The tip cap comprises a pressure side edge and a suction side edge, and a notch formed by a radially inward step adjacent to the suction side edge of the tip cap. The notch is defined by a radially extending step wall and a radially outward facing land. The step wall extends radially inward from the suction side edge of the tip cap to said land, whereby the land is positioned radially inward in relation to a radially outer surface of the tip cap. The notch extends along at least a portion of the suction sidewall in a direction from the leading edge to the trailing edge.

According to a second aspect of the invention, a method for servicing a turbine blade to improve leakage flow control is provided. The turbine blade comprises an airfoil comprising an outer wall formed by a pressure sidewall and a suction sidewall joined at a leading edge and at a trailing edge. The blade comprises a blade tip at a first radial end and a blade root at a second radial end opposite the first radial end for supporting the blade and for coupling the blade to a disc. The blade tip comprises a tip cap disposed over the outer wall of the airfoil and having a pressure side edge and a suction side edge. The method for servicing the turbine blade includes machining a notch forming a radially inward step adjacent to the suction side edge of the tip cap. The notch is defined by a radially extending step wall and a radially outward facing land. The step wall extends radially inward from the suction side edge of the tip cap to said land, whereby the land is positioned radially inward in relation to a radially outer surface of the tip cap. The notch extends along at least a portion of the suction sidewall in a direction from the leading edge to the trailing edge.

BRIEF DESCRIPTION OF THE DRAWINGS

The invention is shown in more detail by help of figures. The figures show specific configurations and do not limit the scope of the invention.

DETAILED DESCRIPTION

In the following detailed description of the preferred embodiment, reference is made to the accompanying drawings that form a part hereof, and in which is shown by way of illustration, and not by way of limitation, a specific embodiment in which the invention may be practiced. It is to be understood that other embodiments may be utilized and that changes may be made without departing from the spirit and scope of the present invention.

Figure 1:
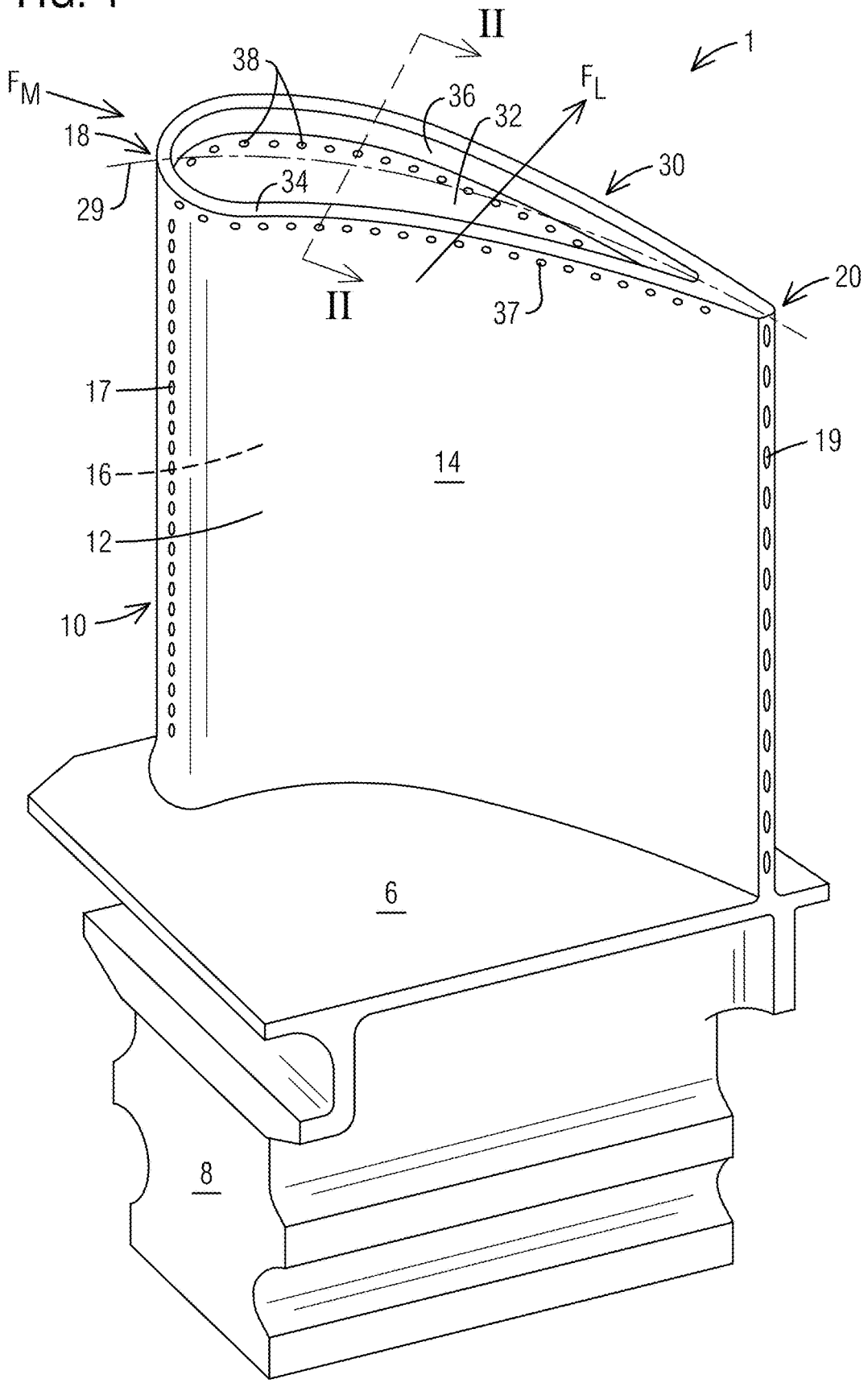
FIG. 1 is a perspective view of a turbine blade with a known type of squealer tip.
Figure 2:
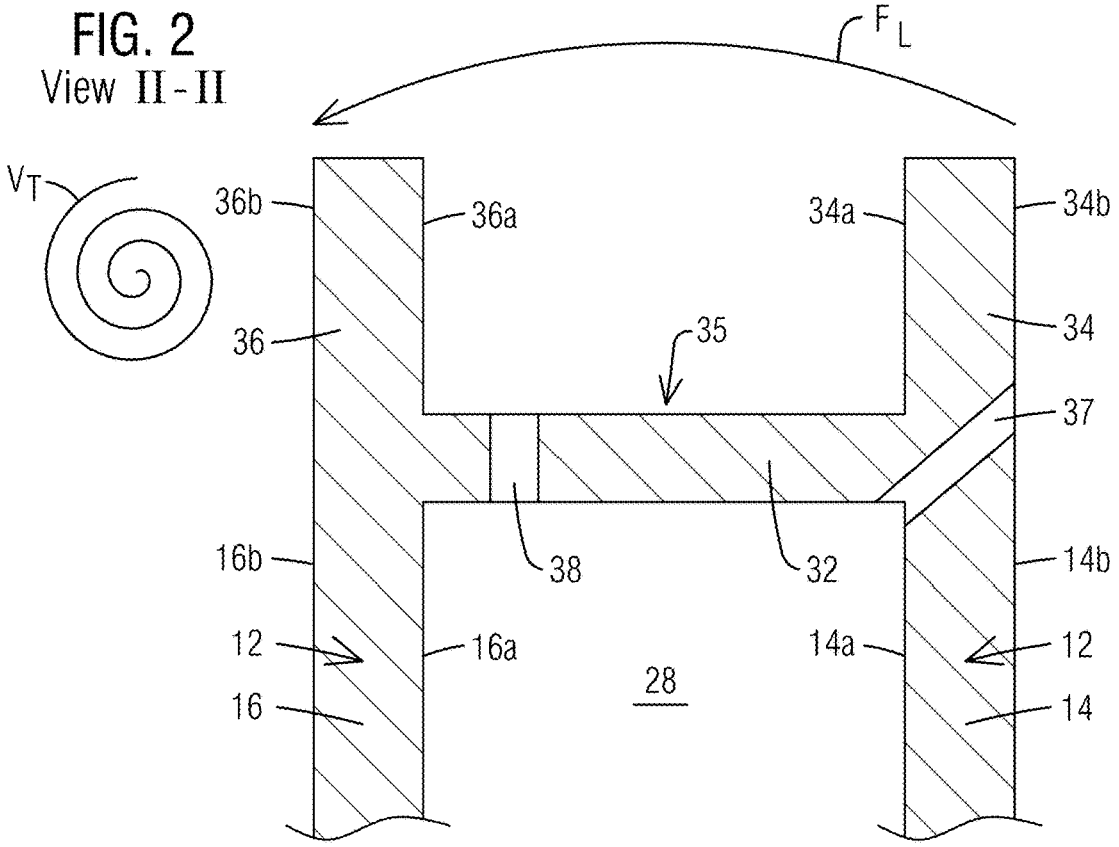
FIG. 2 is a schematic cross-sectional view along the section II-II of FIG. 1.

Referring to the drawings wherein identical reference characters denote the same elements, FIG. 1 illustrates a turbine blade 1. The blade 1 includes a generally hollow airfoil 10 that extends radially outwardly from a blade platform 6 and into a stream of a hot gas path fluid. A root 8 extends radially inward from the platform 6 and may comprise, for example, a conventional fir-tree shape for coupling the blade 1 to a rotor disc (not shown). The airfoil 10 comprises an outer wall 12 which is formed of a generally concave pressure sidewall 14 and a generally convex suction sidewall 16 joined together at a leading edge 18 and at a trailing edge 20 defining a camber line 29. The airfoil 10 extends from the root 8 at a radially inner end to a tip 30 at a radially outer end, and may take any configuration suitable for extracting energy from the hot gas stream and causing rotation of the rotor disc. As shown in FIG. 2, the interior of the hollow airfoil 10 may comprise at least one internal cavity 28 defined between an inner surface 14*a* of the pressure sidewall 14 and an inner surface 16*a* of the suction sidewall 16, to form an internal cooling system for the turbine blade 1. The internal cooling system may receive a coolant, such as air diverted from a compressor section (not shown), which may enter the internal cavity 28 via coolant supply passages typically provided in the blade root 8. Within the internal cavity 28, the coolant may flow in a generally radial direction, absorbing heat from the inner surfaces 14*a*, 16*a* of the pressure and suction sidewalls 14, 16, before being discharged via external orifices 17, 19, 37, 38 into the hot gas path.

Particularly in high pressure turbine stages, the blade tip 30 may be formed as a so-called "squealer tip". Referring jointly to FIG. 1-2, the blade tip 30 may be formed of a tip cap 32 disposed over the outer wall 12 at the radially outer end of the outer wall 12, and a pair of squealer tip walls, namely a pressure side squealer tip wall 34 and a suction side squealer tip wall 36, each extending radially outward from the tip cap 32. The pressure and suction side squealer tip walls 34 and 36 may extend substantially or entirely along the perimeter of the tip cap 32 to define a tip cavity 35 between an inner surface 34*a* of the pressure side squealer tip wall 34 and an inner surface 36*a* of the suction side squealer tip wall 36. An outer surface 34*b* of the pressure side squealer tip wall 34 may be aligned with an outer surface 14*b* of the pressure sidewall 14, while an outer surface 36*b* of the suction side squealer tip wall 36 may be aligned with an outer surface 16*b* of the suction sidewall 16. The blade tip 30 may additionally include a plurality of cooling holes 37, 38 that fluidically connect the internal cavity 28 with an external surface of the blade tip 30 exposed to the hot gas path fluid. In the shown example, the cooling holes 37 are formed through the pressure side squealer tip wall 34 while the cooling holes 38 are formed through the tip cap 32 opening into the tip cavity 35. Additionally or alternately, cooling holes may be provided at other locations at the blade tip 30.

In operation, pressure differences between the pressure side and the suction side of the turbine blade 1 may drive a leakage flow $F_L$ from the pressure side to the suction side through the clearance between the rotating blade tip 30 and the surrounding stationary turbine component (not shown). The leakage flow $F_L$ may lead to a reduction in efficiency of the turbine rotor. There are two primary causes of such an efficiency loss: first, the tip leakage flow $F_L$ exerts no work on the blade, thus reducing the power generated; second, the tip leakage flow $F_L$ may mix with the main flow $F_M$ of the gas path fluid (which is generally along an axial direction) as it exits the clearance gap, rolling up into a vortical structure $V_T$ (see FIG. 2). The vortical structure $V_T$, referred to as tip leakage vortex, results in a pressure loss and a further reduction in rotor efficiency. Configuring the blade tip as a squealer with one or more squealer tip walls 34, 36 may mitigate some of the issues related to tip leakage flow. Typically, the squealer tip walls 34, 36 have a rectangular cross-section, as shown in FIG. 2, wherein the laterally opposed side faces of the squealer tip walls are essentially parallel to each other. Embodiments of the present invention are aimed at further improving tip leakage losses by providing a novel blade tip geometry incorporating a suction side notch.

Figure 3:
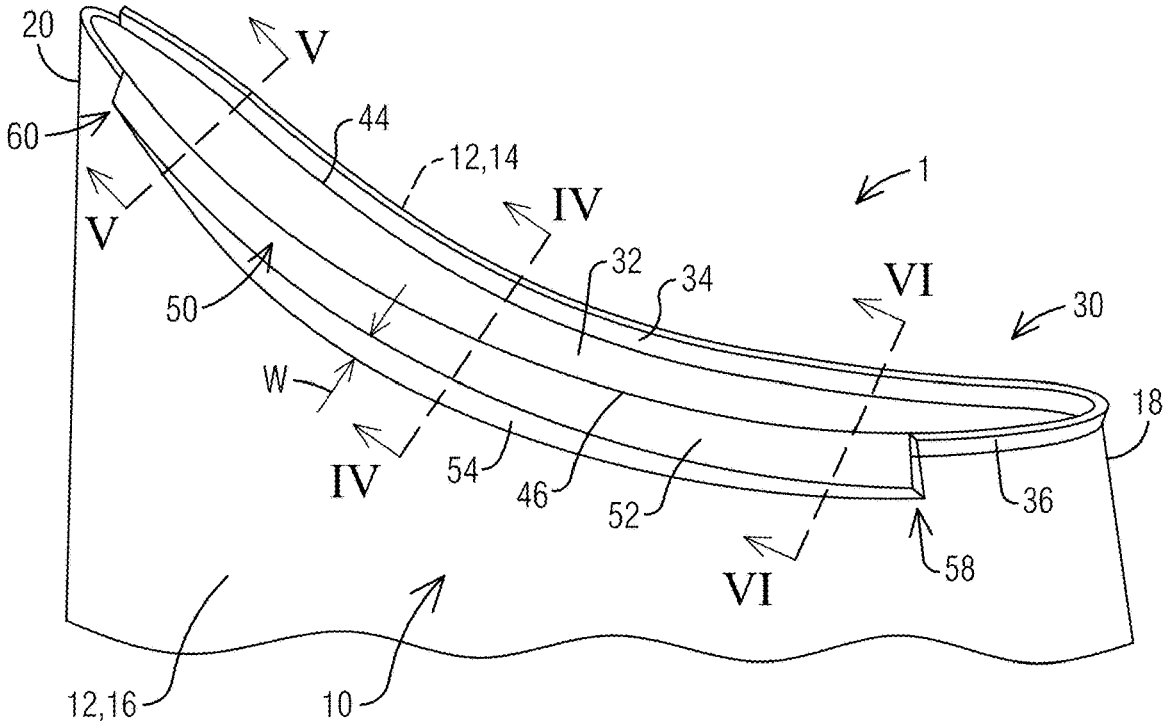
FIG. 3 is a perspective view depicting a blade tip according an embodiment of the present invention incorporating a suction side notch.
Figure 4:
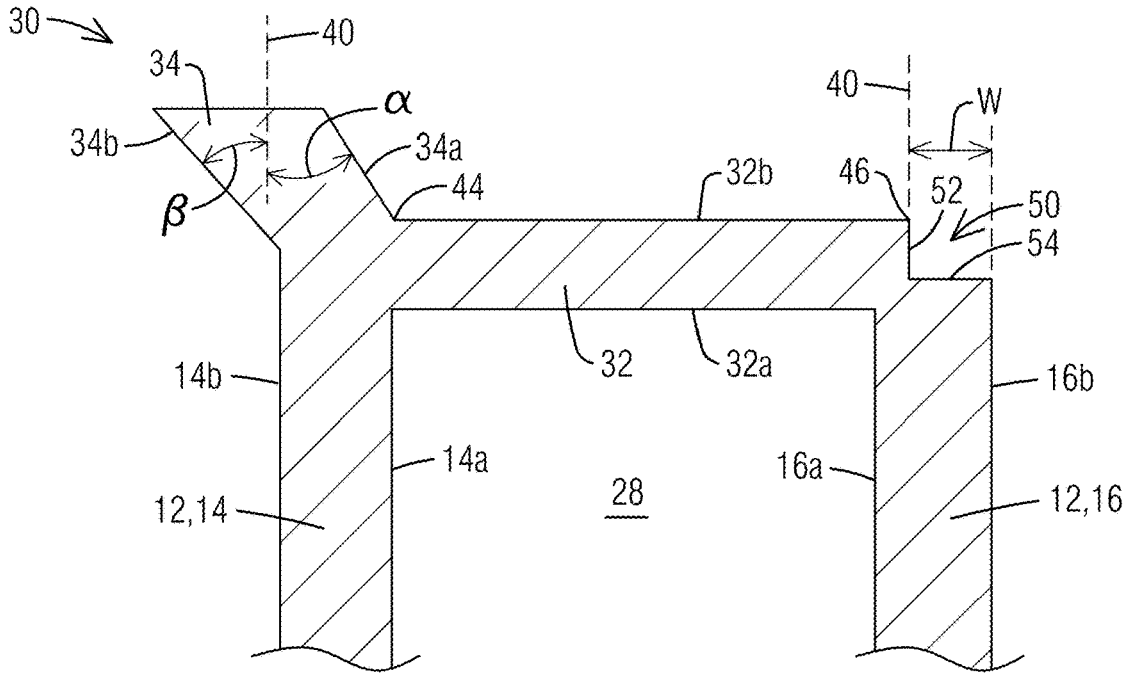
FIG. 4, FIG. 5 and FIG. 6 are schematic cross-sectional views along the sections IV-IV, V-V and VI-VI respectively of FIG. 3.
Figure 5:
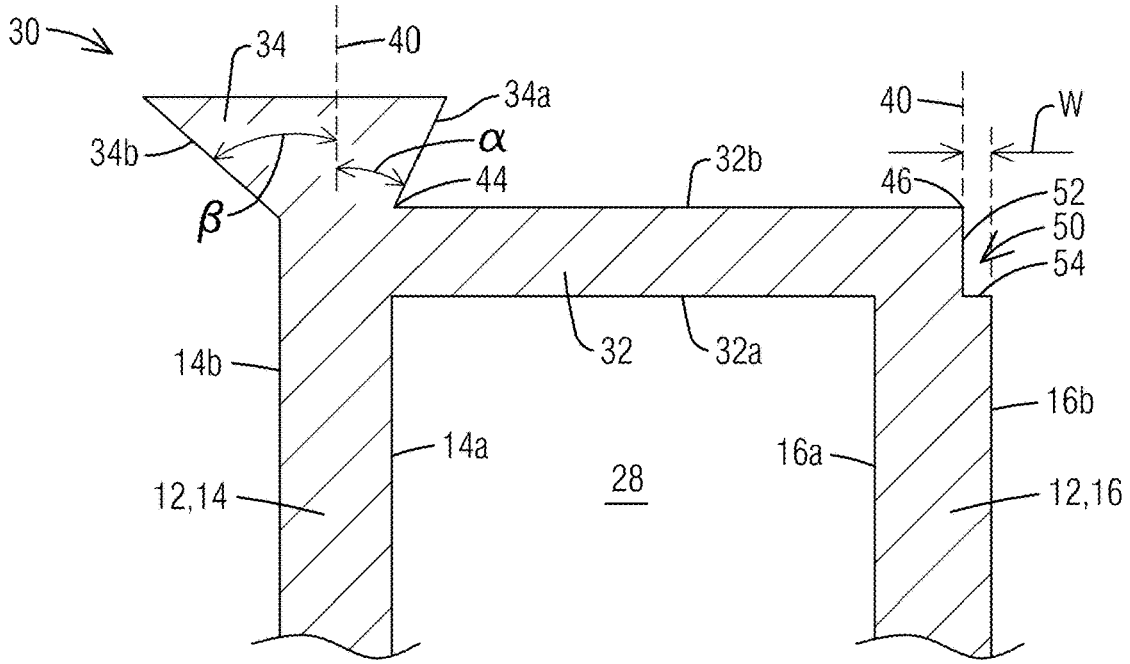
Figure 6:
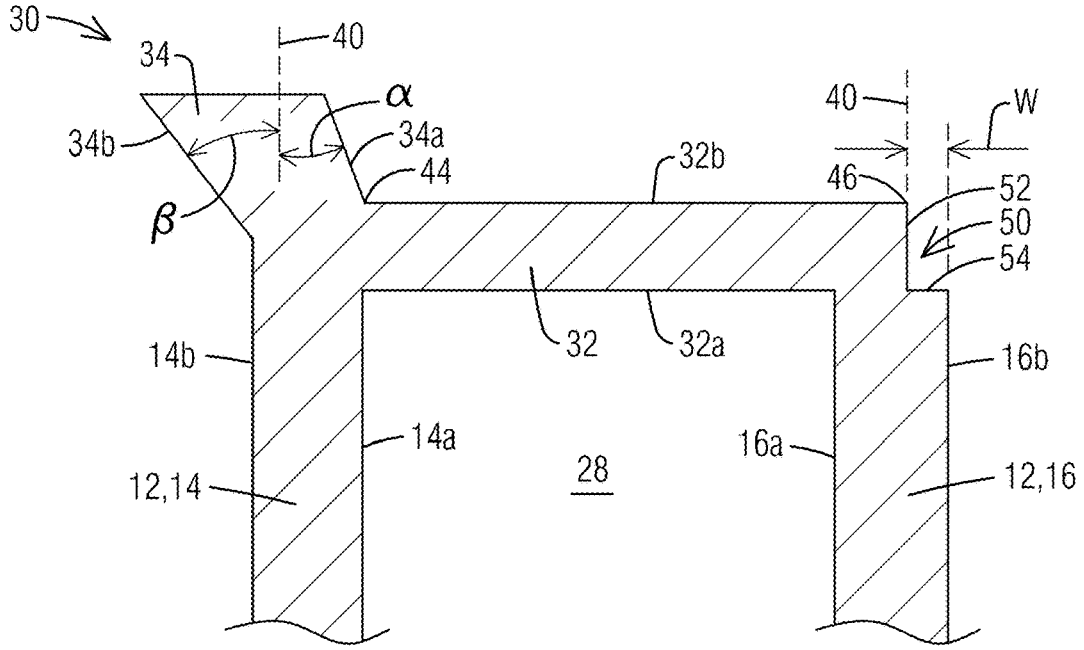

FIG. 3-6 illustrate an exemplary embodiment of the present invention. As shown, a blade tip 30 of a turbine blade 1 includes a tip cap 32 disposed over the airfoil outer wall 12, extending in a chord-wise direction from the leading edge 18 to the trailing edge 20, and in a lateral direction from a pressure side 44 to a suction side edge 46 of the tip cap 32. The tip cap has a radially inner surface 32*a* facing an airfoil internal cooling cavity 28, and has a radially outer external surface 32*b* facing the hot gas path. In contrast to the configuration shown in FIG. 1-2, the illustrated embodiment of the present invention (as best seen in FIG. 4-6) includes a notch 50 formed by a radially inward step adjacent to the suction side edge 46 of the tip cap 32. The notch 50 is defined by a radially extending step wall 52 and a radially outward facing shelf or land 54. The step wall 52 extends radially inward from the suction side edge 46 of the tip cap 32, terminating at the land 54. The land 54 is thereby positioned radially inward in relation to the radially outer surface 32*b* of the tip cap 32. The notch 50 extends along at least a portion of the suction sidewall 16 in a direction from the leading edge 18 to the trailing edge 20. The notch 50 may extend from a first end 58 at or proximal to the leading edge 18 to a second end 60 at or proximal to the trailing edge 20. In the illustrated embodiment, as shown in FIG. 3, the notch 50 extends for a major portion of the chord-wise extent of the suction sidewall 16. In other embodiments, the notch 50 may cover a smaller or larger chord-wise extent of the suction sidewall 16, or even extend all the way from the leading edge 18 to the trailing edge 20.

Figure 7:
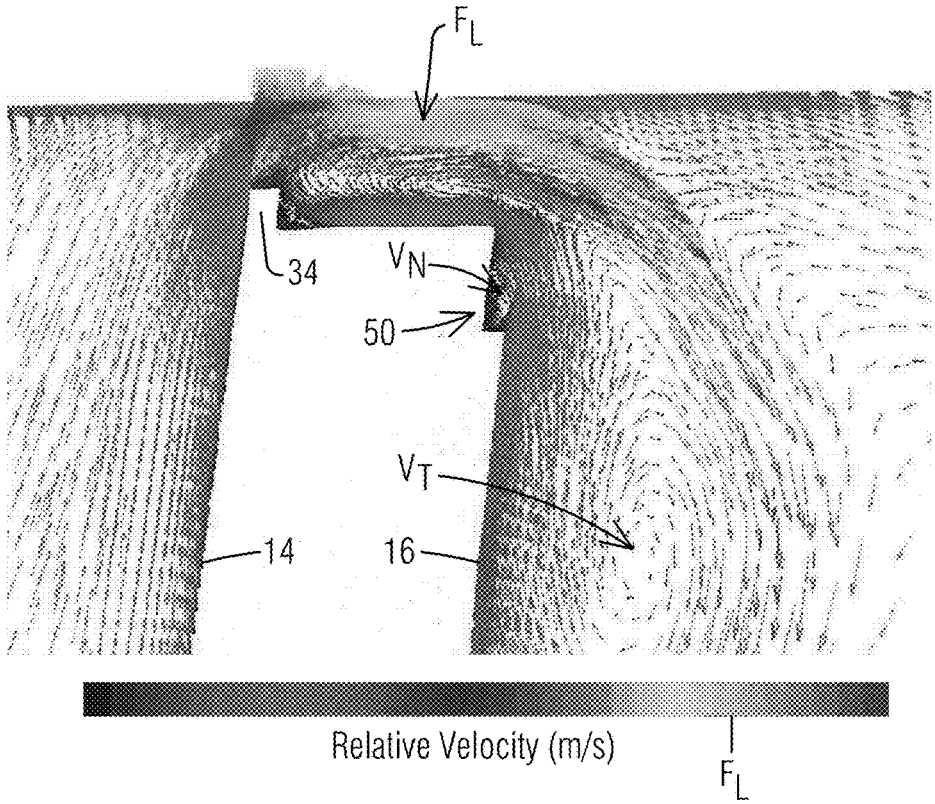
FIG. 7 and FIG. 8 are schematic diagrams illustrating the effect of the local vortex formed by the suction side notch in reducing tip vortex in relation to a baseline squealer tip design.
Figure 8:
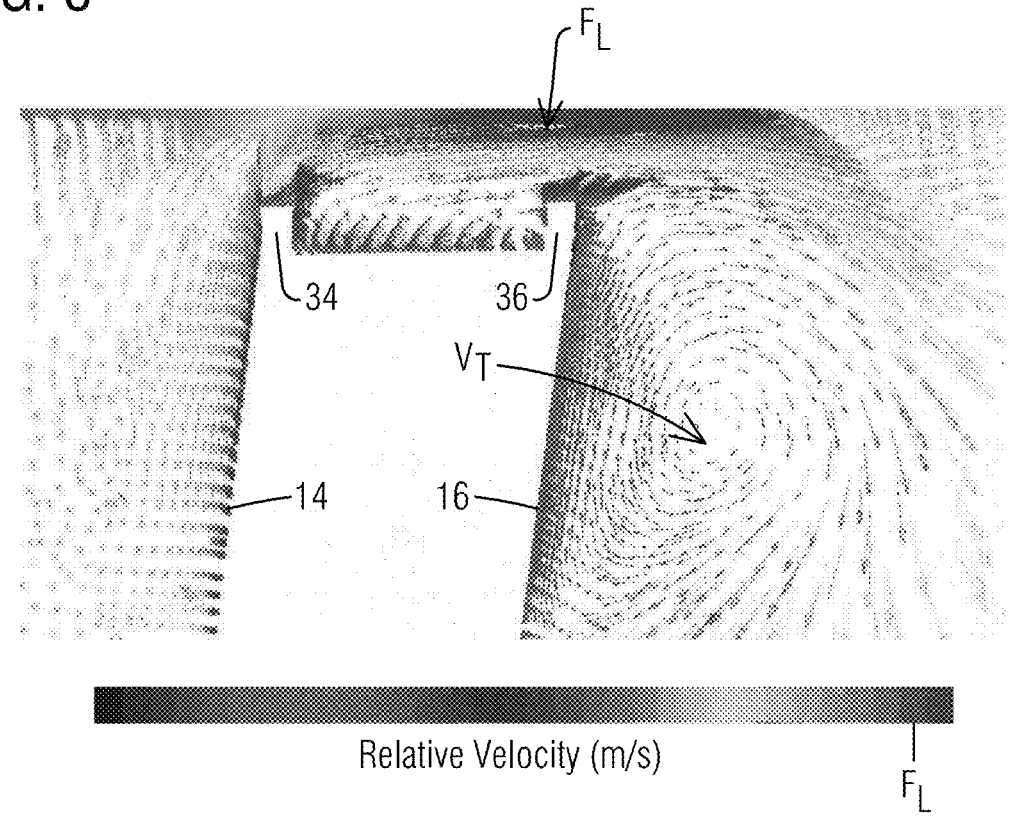

Contrary to conventional wisdom, the notch 50 (with a radially inward step as opposed to a radially outward squealer tip wall) has been found to limit tip leakage flow and thereby improve rotor efficiency. CFD analyses have revealed that the notch 50 actually causes a significant reduction in the tip vortex strength compared with conventional tip designs, including conventional squealer configurations. FIG. 7 and FIG. 8 are schematic diagrams respectively illustrating the aerodynamic effect of a blade tip with the illustrated suction side notch and a blade tip with a baseline squealer tip (similar to the configuration of FIG. 2). As shown in FIG. 7, the cavity created by the notch 50 induces local vortices $V_N$ that create a barrier on the suction side to minimize leakage flow $F_L$. The vortices $V_N$ created by the notch 50 are weaker than the tip vortex $V_T$ and have been found to rotate counter to the tip vortex $V_T$, thereby weakening the tip vortex $V_T$ further as they interact downstream. The local vortices $V_N$ produced by the notch 50 also redirect the leakage flow $F_L$ toward the turbine casing, reducing further interactions with the passage flow, in turn reducing entropy generation due to mixing of the leakage flow and the passage flow. A comparison of the tip leakage flow $F_L$ shown in FIG. 7 (with notch) and FIG. 8 (baseline squealer design) reveals that the suction side notch 50 slows down the flow due to the expanding geometry, leading to a weaker tip vortex $V_T$ and a lesser mass flow of tip leakage $F_L$ in relation to the baseline squealer design. The above result has been schematically indicated in the legends in FIG. 7 and FIG. 8 which have been reproduced in grayscale. Reduction in tip leakage flow results in an increase in power extracted from the hot gas, thereby improving rotor efficiency.

The inventive suction side notch may be configured in several embodiments. In one embodiment, the lateral width W of the land 54 may vary continuously from the first end 58 to the second end 60, as shown in FIG. 3-6. Preferably, the notch 50 may be designed such that the lateral width W of the land 54 is maximum at a location between the first end 58 and the second end 60. The location of maximum width of the land 54 may lie, for example, anywhere between the first end 58 of the notch and 10% axial chord downstream of the location of peak pressure gradient between the pressure side and the suction side. From said location, the lateral width of the land 54 may taper off toward the ends 58, 60, being minimum at the second end 60. A benefit of the above-described shape of the notch 50 is that the vortex created inside the notch 50 pulls up the tip vortex, reducing the generation of entropy, reducing mixing losses, and allowing more of the airfoil surface to produce work. It will be appreciated that the notch 50 may be optimized to other shapes with different variations in the land width. In still other embodiments, the notch 50 may be formed such that the lateral width of the land is constant from the first end 58 to the second end 60, i.e., the land may be essentially rectangular.

In the shown example, the step wall 52 of the notch 50 is parallel to the radial axis 40, and orthogonal to the land 54. Thereby the land 54 is parallel to the radially outer surface 32*b* of the tip cap 32. In various other embodiments, the step wall 52 may be non-parallel to the radial axis 40 and/or may be non-orthogonal to the land 54. In one embodiment, the radial height of the step wall 52 may be in the range of 1.5% to 4% of the airfoil span. However, the above embodiment is non-limiting. For example, in certain applications, the radial height of the step wall 52 may fall in the range of 0.5% to 10% of the airfoil span.

Embodiments of the suction side notch described above may partially or completely replace a "squealer" configuration of the blade tip. In the illustrated embodiments, the suction side notch 50 replaces a portion of the suction side squealer tip wall 36 (see FIG. 3). As shown in FIG. 3-6, the blade tip 30 may be provided with an optional feature of a pressure side squealer tip wall 34, which, in combination with the suction side notch 50, leads to a further improvement in leakage flow control. The pressure side squealer tip wall 34 extends radially outward from the tip cap 32 adjacent to the pressure side edge 44 of the tip cap 32. The pressure side squealer tip wall 34 may be aligned with the pressure sidewall 14, extending along at least a portion thereof, in a direction from the leading edge 18 to the trailing edge 20.

The pressure side squealer tip wall 34 comprises laterally opposite first and second side faces 34*a* and 34*b* respectively. In one variant, the geometry of the squealer tip wall 34 may be configured, such that first side face 34*a* and/or the second side face 34*b* is inclined with respect to the radial axis 40. In the current example, as depicted in the chord-wise spaced apart cross-sectional views in FIG. 4-6, the first side face 34*a* and the second side face 34*b* of the pressure side squealer tip wall 34 are oriented at respective angles which vary independently along the chord-wise direction, such that the chord-wise variation of a first angle $\alpha$ between the first side face 34*a* and the radial axis 40 is different from the chord-wise variation of a second angle $\beta$ between the second side face 34*b* and the radial axis 40. Consequently, the angle between the inner and outer side faces 34*a*, 34*b* varies in the chord-wise direction. The variably inclined squealer geometry may be optimized, for example, to provide a larger angle of inclination in regions where a high tip leakage flow has been identified.

In the depicted example, the chord-wise varying inclination of the first and second side faces 34*a*, 34*b* is provided along the entire axial length (from the leading edge to the trailing edge) of the pressure side squealer tip wall 34. In other embodiments, such a variable inclination of the first and second side faces 34*a*, 34*b* may be provided only for a designated portion extending partially along the axial length of the pressure side squealer tip wall 34. In still other embodiments, the pressure side squealer tip wall 34 may have a different geometry, for example, having a rectangular shape with the side faces 34*a*, 34*b* being parallel to each other, with variable or constant inclination along the chord-wise direction.

Although not shown, the blade tip 30 may also comprise cooling holes or channels provided in the suction side notch 50 and/or the squealer tip wall 34, which are in fluid communication with an internal cooling system within the airfoil. The illustrated blade tip shaping may make efficient use of the cooling flow by controlling the trajectory of the tip leakage flow. Simultaneous optimization of the tip shape and the cooling hole/channel location may thus make use of the change of tip flow trajectory to cool the blade tip, allowing reduced cooling flow, improved engine efficiency and increased component lifetime.

Aspects of the present invention may also be directed to a method for servicing a blade to improve leakage flow control, which includes machining a suction side notch as described above.

While specific embodiments have been described in detail, those with ordinary skill in the art will appreciate that various modifications and alternative to those details could be developed in light of the overall teachings of the disclosure. Accordingly, the particular arrangements disclosed are meant to be illustrative only and not limiting as to the scope of the invention, which is to be given the full breadth of the appended claims, and any and all equivalents thereof.

The invention claimed is:

1. A turbine blade comprising:

an airfoil comprising an outer wall formed by a pressure sidewall and a suction sidewall joined at a leading edge and at a trailing edge, a blade tip at a first radial end and a blade root at a second radial end opposite the first radial end for supporting the blade and for coupling the blade to a disc, wherein the blade tip comprises:

a tip cap disposed over the outer wall of the airfoil, the tip cap comprising a pressure side edge and a suction side edge, and a notch formed by a radially inward step adjacent to the suction side edge of the tip cap, the notch being defined by a radially extending step wall and a radially outward facing land, the step wall extending radially inward from the suction side edge of the tip cap to said land, whereby the land is positioned radially inward in relation to a radially outer surface of the tip cap, wherein the notch extends along at least a portion of the suction sidewall in a direction from the leading edge to the trailing edge, wherein the land extends from a first end at or proximal to the leading edge and a second end at or proximal to the trailing edge, wherein a lateral width of the land varies from the first end to the second end, and wherein a lateral width of the land at the second end is narrower than a lateral width of the land at the first end.

2. The turbine blade according to claim 1, wherein a minimum lateral width of the land is located at the second end.

3. The turbine blade according to claim 1, wherein a maximum lateral width of the land is located between the first end and the second end.

4. The turbine blade according to claim 1, wherein the step wall is orthogonal to the land.

5. The turbine blade according to claim 4, wherein the land is parallel to the radially outer surface of the tip cap.

6. The turbine blade according to claim 1, further comprising a pressure side squealer tip wall extending radially outward from the tip cap adjacent to the pressure side edge of the tip cap.

7. The turbine blade according to claim 6, wherein the pressure side squealer tip wall comprises laterally opposite first and second side faces, wherein the first side face and/or the second side face is inclined with respect to a radial axis.

8. The turbine blade according to claim 7, wherein the first side face and the second side face of the pressure side squealer tip wall are oriented at respective angles which vary independently along the chord-wise direction, such that the chord-wise variation of a first angle between the first side face and the radial axis is different from the chord-wise variation of a second angle between the second side face and the radial axis.

9. A method for servicing a turbine blade to improve leakage flow control, the turbine blade comprising an airfoil comprising an outer wall formed by a pressure sidewall (14) and a suction sidewall joined at a leading edge and at a trailing edge, the blade further comprising a blade tip at a first radial end and a blade root at a second radial end opposite the first radial end for supporting the blade and for coupling the blade to a disc, the blade tip comprising a tip cap disposed over the outer wall, the tip cap comprising a pressure side edge and a suction side edge, the method comprising:

machining a notch to form a radially inward step adjacent to the suction side edge of the tip cap, the notch being defined by a radially extending step wall and a radially outward facing land, the step wall extending radially inward from the suction side edge of the tip cap to said land, whereby the land is positioned radially inward in relation to a radially outer surface of the tip cap, wherein the notch extends along at least a portion of the suction sidewall in a direction from the leading edge to the trailing edge, wherein the land extends from a first end at or proximal to the leading edge and a second end at or proximal to the trailing edge, wherein a lateral width of the land varies from the first end to the second end, and wherein a lateral width of the land at the second end is narrower than a lateral width of the land at the first end.

10. The method according to claim 9, wherein a minimum lateral width of the land is located at the second end.

11. The method according to claim 9, wherein a maximum lateral width of the land is located between the first end and the second end.

12. The method according to claim 9, wherein the step wall is orthogonal to the land.

13. The method according to claim 12, wherein the land is parallel to the radially outer surface of the tip cap.

* * * * *